United States Patent [19]

Gutierrez et al.

[11] Patent Number: 4,600,519

[45] Date of Patent: Jul. 15, 1986

[54] PROCESS FOR IMPROVING FRICTION MODIFICATION PROPERTIES OF A POWER TRANSMISSION FLUID WITH AN ALKYLTHIO SUCCINIC ACID OR ANHYDRIDE

[75] Inventors: Antonio Gutierrez, Mercerville; Rosemary O'Halloran, Union; Stanley J. Brois, Westfield, all of N.J.

[73] Assignee: Exxon Research & Engineering Co., Florham Park, N.J.

[21] Appl. No.: 717,554

[22] Filed: Mar. 29, 1985

Related U.S. Application Data

[62] Division of Ser. No. 464,950, Feb. 8, 1983.

[51] Int. Cl.[4] ..... C10M 135/26

[52] U.S. Cl. ..... 252/48.6

[58] Field of Search ..... 252/48.6

[56] References Cited

U.S. PATENT DOCUMENTS

| | | | |
|---|---|---|---|
| 2,581,514 | 1/1952 | Chilcote | 252/48.6 |
| 4,264,460 | 4/1981 | Gutierrez et al. | 252/48.6 |
| 4,344,853 | 8/1982 | Gutierrez et al. | 252/48.6 |
| 4,411,808 | 10/1983 | Gutierrez et al. | 252/48.6 |

*Primary Examiner*—Jacqueline V. Howard

*Attorney, Agent, or Firm*—J. J. Mahon; R. A. Maggio

[57] ABSTRACT

There are disclosed power shift transmission fluids such as automatic transmission fluids containing a friction modifier additive being an oil soluble alkylthio succinic anhydride or acid, such as octadecyl thiosuccinic acid or anhydride.

3 Claims, No Drawings

PROCESS FOR IMPROVING FRICTION MODIFICATION PROPERTIES OF A POWER TRANSMISSION FLUID WITH AN ALKYLTHIO SUCCINIC ACID OR ANHYDRIDE

This case is a Rule 60 division of Ser. No. 464,950 filed Feb. 8, 1983.

This invention relates to power transmission shift fluids, such as automatic transmission fluids, which contain an additive effective in providing friction modification benefits.

Mineral oil based power transmisson shift fluids, or functional fluids, such as automatic transmission fluids are required to exhibit a number of properties such as antiwear, friction modification, oxidation inhibition, anticorrossion, demulsification and the like in order to qualify for commercial acceptance.

Prior art references pertinent to this invention include U.S. Pat. No. 3,852,205 issued Dec. 3, 1974 to Kablaoui et al. which discloses automatic transmission fluid containing either S-carboxy alkylene hydrocarbyl succinimide or hydrocarbylsuccinamic acid. These are prepared in a two stage process comprising reacting maleic anhydride with a primary amine in a 1:1 mole ratio. The amine and imide product so formed is then contacted with a thiocarboxylic acid to form the desired additive. U.S. Pat. No. 4,129,510 issued Dec. 12, 1978 to Smith disclosed sulfur-containing additive derived from reacting a hydrocarbyl mercaptan having 1 to 5 SH groups with a $C_3$ to $C_{38}$ aldehyde or ketone to form an intermediate which is subsequently reacted with an olefinic carboxylic acid or functional derivative. The products are said to be useful as oxidation and rust inhibitors in lubricants and fuels.

In accordance with the present invention there have been discovered power transmission shift fluid compositions comprising a major amount of a mineral oil of lubricating viscosity on an oil soluble alkylthio succinic anhydride or acid additive in an amount to provide effective friction modification, the additive being represented by the formulas:

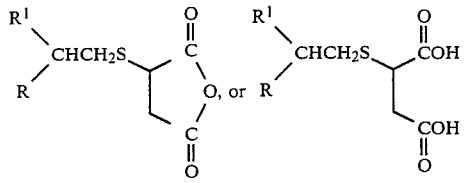

wherein R′ is an alkyl of about 8 to 39 carbon atoms and R is a lower $C_1$–$C_4$ alkyl or hydrogen. Preferred are those compounds where the total $R'(R)CHCH_2$— group has about 16 to 20, such as 18, carbon atoms.

A particularly preferred embodiment of the present invention is the addition product of octadecyl mercaptan with maleic anhydride. Compounds of the invention may also be prepared by addition of mercapto diacids to terminal olefins, e.g., $R'(R)C{=}CH_2$.

The compositions of the present invention may contain the additive generally within the range of about 0.01 to 1 wt% to provide the effective friction properties. Preferably, the power transmission shift fluids will contain about 0.1 to 0.5 wt% of the additive of the present invention. Octadecyl thiosuccinic acid or anhydride are preferred additives of this invention.

In addition to use in automatic transmission fluids the additive of the present invention will function as a friction modifier in other power transmission shift fluids based on mineral oil such as hydraulic fluids, power brake and power steering fluids, heavy duty equipment fluids and the like.

Friction modification is one of the most demanding properties to effectively provide in an automatic transmission fluid and is considered the characteristic which distinguishes ATF compositions from other categories of lubricants. Very specific frictional properties related to transmission parts operation must be met in order to have an acceptable fluid. The additive of the present invention is highly advantageous in that it satisfies at low treat levels the significant friction modification tests, and is efficiently prepared at relatively lower costs thereby providing a more effective and economical automatic transmission fluid. The properties evaluated in ATF tests and specifications are generally applicable to other power shift transmission fluids.

Automatic transmission fluids containing the additive of the present invention are the preferred embodiment. Such ATF compositions contain a number of conventional additives in amounts providing their normal attendant functions and are typically blended into the mineral oil base in the following ranges:

| Components | Concentration Range (Vol. %) |
|---|---|
| V.I. Improver | 1–15 |
| Corrosion Inhibitor | 0.01–1 |
| Oxidation Inhibitor | 0.01–1 |
| Dispersant | 0.5–10 |
| Pour Point Depressant | 0.01–1 |
| Demulsifier | 0.001–0.1 |
| Anti-Foaming Agents | 0.001–0.1 |
| Anti-Wear Agents | 0.001–1 |
| Seal Swellant | 0.1–5 |
| Friction Modifier | 0.01–1 |
| Mineral Oil Base | Balance |

Typical base oils for automatic transmission fluids and power transmission shift fluids generally include a wide variety of light hydrocarbon mineral oils, such as, naphthenic base, paraffin base and mixtures thereof, having a lubricating viscosity range of about 34 to 45 SUS (Saybolt Universal Seconds) at 38° C.

The invention is further illustrated by the following examples which are not to be considered as limitative of its scope. ATF compositions used in the examples below were formulated in accordance with the components and concentrations noted above (referred to as Base Fluid) except the friction modifier was the compound of this invention used in the amounts reported below.

EXAMPLE 1

About 100 g (0.35 moles) of octadecyl mercaptan were dissolved in 100 ml of tetrahydrofuran (THF). Then, about 34.2 g (0.35 moles) of maleic anhydride were added, followed by the addition of 1 ml of triethylamine as catalyst. The reaction mixture was heated to reflux for about one hour. At the end of the hour, the THF solution was poured into a large volume of pentane and a white solid precipitated out of solution. The white solid was filtered, and dried in vacuo until constant weight. The infrared spectrum of the solid revealed no unreacted maleic anhydride present. It analyzed for 68.85% C, 10.52% H and 8.77% S which is consistent with the desired alkylthio succinic anhydride that required 68.70% C, 10.48% H and 8.34% S.

EXAMPLE 2

About 30 g (0.2 mole) of mercapto-succinic acid were dissolved in 200 ml of methanol and cooled to about 15° C. Thereafter, 56 g (0.2 mole, 90%) of 1-octadecene were added, followed by the addition of 1.5 g of Lucidol 70 radical initiator (Benzoyl peroxide, 70%). The reaction mixture was rapidly stirred for about two hours, while some crystalline white solid formed. The reaction temperature rose to 30° C. during the first half hour and then about 25° C. for the rest of the reaction time. The white solid was filtered and collected. The infared spectrum of the solid is consistent with the desired 2-(octadecylthio) succinic acid. The solid analyzed for 66.77% C, 1045% H, and 8.10% S. Theory requires 65.67% C, 10.52% H and 7.97% S.

EXAMPLE 3

To a formulated automatic transmission fluid (Base Fluid) was added 0.25 wt% of the octadecylthio succinic anhydride of Example 1 and the fluid was evaluated for its friction properties in the Davison Friction Test utilizing the SAE No. 2 Friction Machine; dynamic and static torque values were within the test specification of General Motor Dexron ® II Automatic Transmission Fluid (GM specification G137-M, July, 1980). Torque values were measured at 3 phases: (1) 16,500 lb-ft, 1 sec. lock-up, (2) 7200 lb-ft, 40 lb. pressure and (3) 16,500 lb ft, 60 lb pressure. Phase 1 friction torque tracings showed results of 102, 91 and 84; phase 2 showed 101, 97 and 88 and phase 3 showed 138, 130 and 123 ft-lbs.

What is claimed is:

1. A process for improving the friction modification properties of a power transmitting fluid comprising a major amount of mineral oil of lubricating viscosity and a friction modifying agent which comprises employing as the friction modifying agent from about 0.01 to about 1 wt%, based on the weight of the power transmitting fluid, of at least one compound represented by structural formulas:

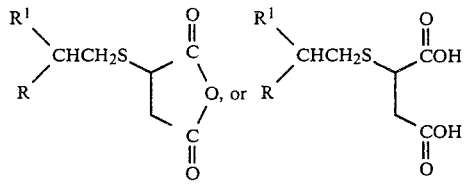

wherein, R′ is an alkyl of about 8 to 30 carbon atoms and R is a lower $C_{1-4}$ alkyl or hydrogen.

2. The process of claim 1 wherein the power transmission fluid is an automatic transmission fluid.

3. The process of claim 1 wherein the R′(R)CH—$CH_2$— group of said structural formulas has a total of about 16 to 20 carbon atoms.

* * * * *